US005405018A

United States Patent [19]

Anthrop, Jr.

[11] Patent Number: 5,405,018

[45] Date of Patent: Apr. 11, 1995

[54] DISHWASHER ATTACHMENT FOR SUPPORTING A FREEZER BAG

[76] Inventor: Walter H. Anthrop, Jr., 19 Tremont St., Kingston, Mass. 02364

[21] Appl. No.: 70,979

[22] Filed: Jun. 4, 1993

[51] Int. Cl.[6] ..... A47F 7/00; B65B 67/12

[52] U.S. Cl. ..... 211/13; 248/95; 248/101; 248/99; 211/41

[58] Field of Search ..... 211/13, 41; 248/95, 248/97, 99, 101, 499, 311.3, 154

[56] References Cited

U.S. PATENT DOCUMENTS

| | | | |
|---|---|---|---|
| 3,289,854 | 12/1966 | Kauffman | 211/41 |
| 3,451,557 | 6/1969 | Stoddard | 211/41 |
| 4,593,822 | 6/1986 | Yeaney et al. | 211/41 |
| 4,635,799 | 1/1987 | Penner | 211/41 |
| 4,748,993 | 6/1988 | Liewellyn | 134/166 |
| 4,832,206 | 5/1989 | Cunningham | 211/41 |
| 4,974,806 | 12/1990 | Matern | 248/499 |
| 5,080,237 | 1/1992 | Hefner | 211/13 |
| 5,102,076 | 4/1992 | North et al. | 248/95 |
| 5,188,244 | 2/1993 | Hollstegge | 211/71 |

FOREIGN PATENT DOCUMENTS

| | | | |
|---|---|---|---|
| 1121082 | 4/1956 | France | 211/13 |

*Primary Examiner*—Leslie A. Braun
*Assistant Examiner*—Catherine S. Collins
*Attorney, Agent, or Firm*—Richard C. Litman

[57] ABSTRACT

A dishwasher rack attachment for use in washing plastic bags, such as freezer bags and the like. The attachment includes a hose and a clip. The hose is engageable with any two of the prongs of the dishwasher rack so as to accommodate various sized freezer bags. The clip is slidably engageable with the hose and is configured to secure a plastic bag to the hose. The position of the clip is slidably adjustable relative to the hose so as to accommodate freezer bags of varying dimensions.

2 Claims, 2 Drawing Sheets

DISHWASHER ATTACHMENT FOR SUPPORTING A FREEZER BAG

BACKGROUND OF THE INVENTION

1. Field of the Invention

The present invention relates to supports and racks and, more particularly, to a dishwasher attachment for supporting a freezer bag and the like.

2. Description of the Prior Art

Plastic bags, such as freezer bags and sandwich bags, are becoming more and more popular with ongoing improvements of the same. Typically, the bags are very durable because of the weight and the composition of the contents to be stored therein. Because of their durable design, the bags could withstand repeated use. A problem, however, arises in that once the contents of the bags are removed, residue remains in the bag, making the bag impractical for repeated usage. These durable bags pose yet another problem. The disposal of such bags has become a chief concern of landfills. These bags are disposed of in large quantities and they take relatively long periods of time to decompose. An effortless, efficient, and practical manner of cleansing these bags after use could overcome the present problems associated with the use of plastic bags. A device for retaining plastic bags which could be easily installed in a dishwasher could provide an effortless, efficient, and practical manner of cleaning the plastic bags. Such a device should retain the bag secured in an open posture. The present invention to be disclosed hereinafter provides structure for supporting the bag and a clip for securing the bag to the support structure.

Article retaining devices for use in dishwashers are known in the prior art. For example, U.S. Pat. No. 3,289,854, issued Dec. 6, 1966 to Melvin R. Kauffman, discloses a retaining device which is adapted for use with dish supporting racks. Other retaining devices are shown in U.S. Pat. Nos. 4,635,799, issued Jan. 13, 1987 to Maureen Penner; 4,748,993, issued Jun. 7, 1988 to Scott Llewellyn; 4,832,206, issued May 23, 1989 to George D. Cunningham; and 4,974,806, issued Dec. 4, 1990 to Stephen Matern. Supporting devices are also known in the prior art. One such supporting article, for example, is shown in U.S. Pat. No. 3,451,557, issued Jun. 24, 1969 to Edgar S. Stoddard who discloses removable article supporting devices for use with automatic dishwasher racks. A rack showing detachable components is shown in U.S. Pat. No. 4,593,822, issued to Gerald L. Yeaney et al.

Various holders and racks are known for supporting plastic bags to aid in the washing and drying of the same. Examples of such holders and racks are shown in U.S. Pat. Nos. 5,080,237, issued Jan. 14, 1992 to James P. Hefner; 5,102,076, issued Apr. 7, 1992 to Alan S. North et al.; and 5,188,244, issued Feb. 23, 1993 to Jerome E. Hollstegge. However, none of these holders or racks are for use in dishwashers. Moreover, none of the above patents, taken either singly or in combination, is seen to describe the instant invention as claimed.

SUMMARY OF THE INVENTION

The present invention is a dishwasher rack attachment for use in washing a plastic bag. The attachment includes a support and a clip. The support is defined by a tube or hose which is engageable with the rack of a dishwasher. The clip is slidably engageable with the hose. The clip is configured to secure a plastic bag to the hose. The position of the clip relative to the hose is slidably adjustable in accordance with the dimensions of the bag. Further, the hose is engageable with any two of the prongs of the dishwasher rack so as to accommodate various sized bags as well.

Accordingly, it is a principal object of the invention to provide a dishwasher rack attachment for use in washing a plastic bag.

It is another object that the dishwasher rack attachment include a support in which the bag is attachable and a clip for securing the bag to the support.

It is a further object that the support be defined by a tube or hose which is engageable with any two prongs of the dishwasher rack so as to accommodate various size bags.

Still another object is that the clip be slidably engageable with the hose so as to be slidably adjustable in accordance with the dimensions of the bag.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
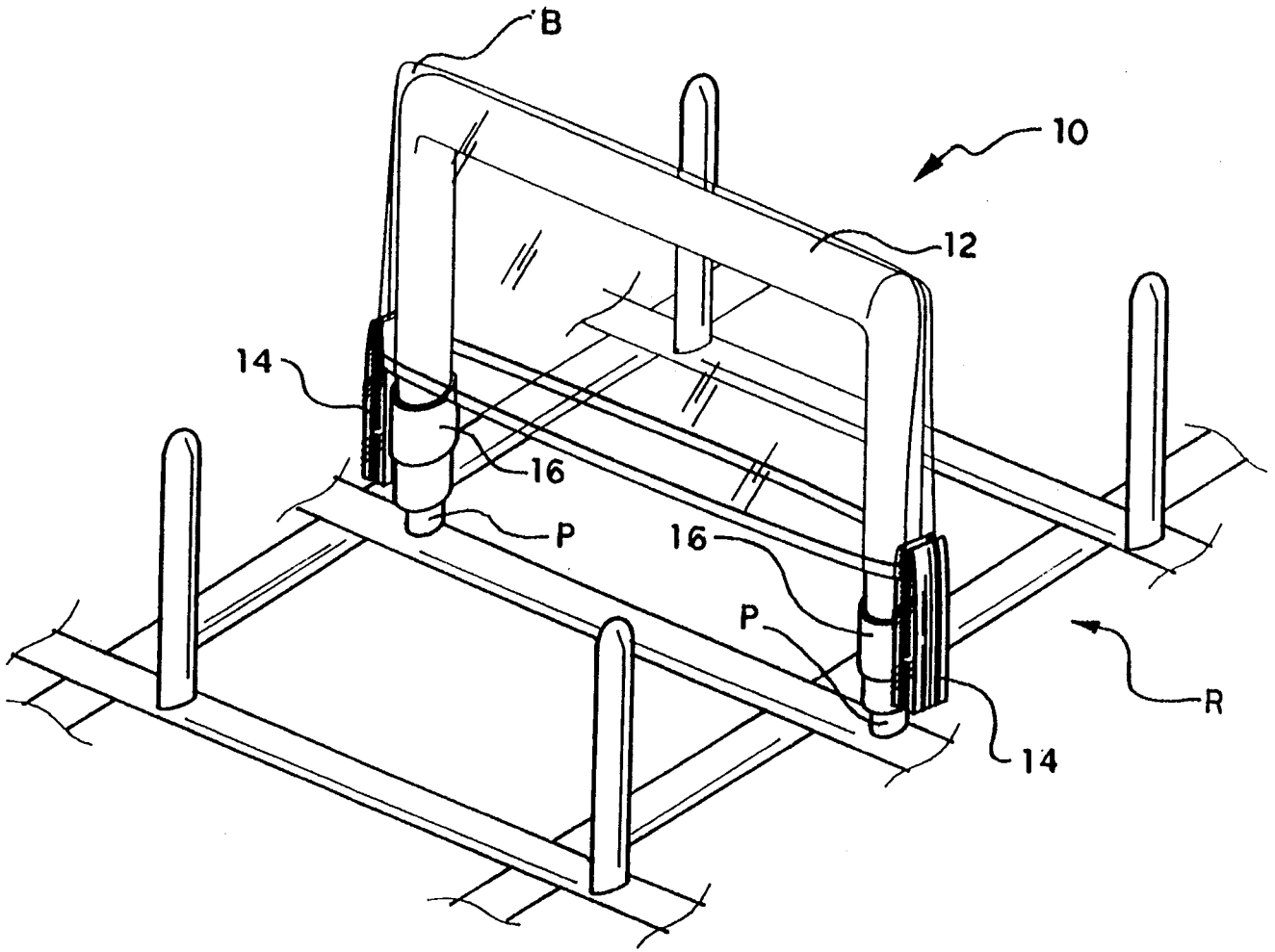
FIG. 1 is an environmental perspective view of a dishwasher rack attachment according to the present invention.
Figure 3:
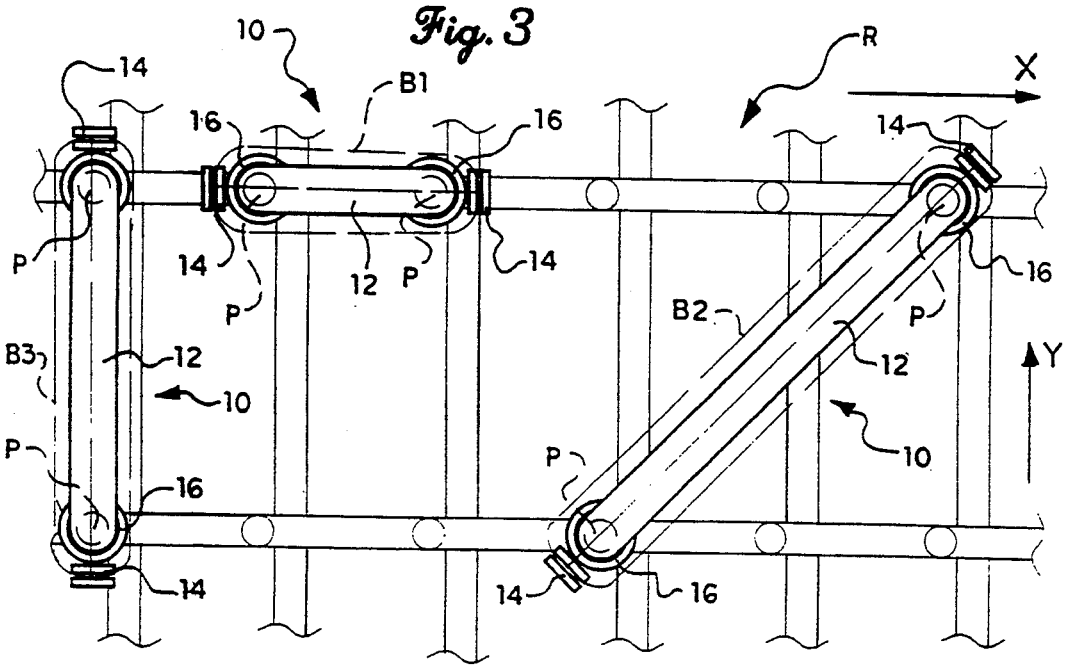
FIG. 3 is a top plan view of three dishwasher rack attachments according to the present invention.

The present invention, as shown in FIG. 1, is an attachment 10 for use in a dishwasher for washing soiled freezer bags B and the like. The dishwasher attachment 10 comprises a support formed from a tube or hose 12. The hose 12 is preferably fabricated of a semirigid rubber, plastic or vinyl material. The hose 12 is engageable with the rack R of the dishwasher. In particular, the hose 12 is slidably engageable with an upright member or prong P of the dishwasher rack R. The inside diameter of the hose 12 is such that a tight fit relationship exists between the hose 12 and the prong P. The hose 12 is dimensioned such that it may extend to various prongs P of the dishwasher rack R in order to accommodate various sized bags B1, B2 and B3, as shown in FIG. 3. Typically, dishwasher racks R have prong P arranged such that the same are spaced further apart in a first direction Y than in a second direction X. Hence, the hose 12 could be engaged with substantially any two prongs P extending either along the first direction Y, along the second direction X, or diagonally to support bags B of various sizes. The hose 12 may be routed to support a bag B in such a manner that the dishwasher may be used to support dishes (not shown) in its fullest capacity.

Figure 2:
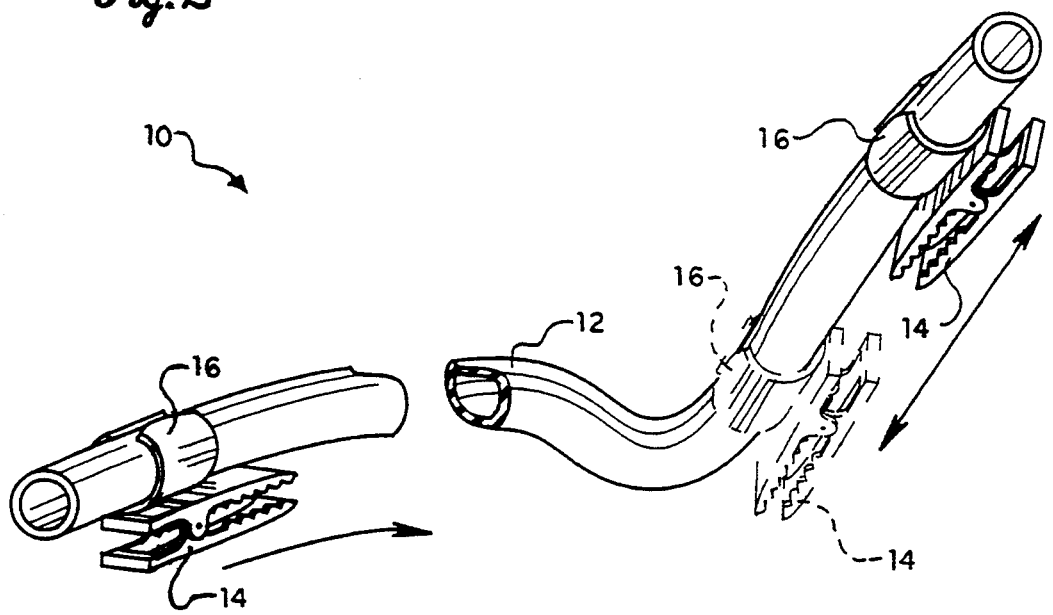
FIG. 2 is a perspective view of the attachment shown in FIG. 1.

Clips 14 are provided for securing the bag B to the hose 12. Preferably, the clip 14 is adjustable relative to the hose 12 to further accommodate bags B of varying dimensions. As shown in FIGS. 1 and 2, collars 16 are slidably engagable with the hose 12, and the clips 14 are fixedly attached to the collars 16. By sliding each collar 16 along the length of the hose 14, the position of each respective clip 14 is displaced. It should be understood that other means may be employed in substitution of the collars 16.

In use, the bag B is preferably turned inside out first. With the bag B in this posture, the hose 12 is inserted therein, as is shown more clearly in FIG. 1. The clips 14 are slidably adjusted so as to be clamped about the mouth of the bag B and to hold the bag B taut on the hose 12. The hose 12 is now attached to any two of the prongs P of the dishwasher rack R in accordance with the width of the bag B to be washed. As shown in FIG. 3, the hose 12 may be extended in various directions to provide a suitable support structure for a bag B. It is possible that the hose 12 may be arranged so as to not to interfere with the normal loading of the dishwasher. As the dishwasher is operated, the bags B are washed and dried during the course of its operating cycle.

It is to be understood that the present invention is not limited to the embodiments described above, but encompasses any and all embodiments within the scope of the following claims.

I claim:

1. A dishwasher rack attachment for use in washing a plastic bag, said attachment comprising:

a semi-rigid support tube for slidable engagement with prongs of a rack of a dishwasher;

a collar which is slidably engageable with said support tube; and at least one clip fixedly attached to said collar for securing a plastic bag to said support tube, whereby a positioning of said at least one clip relative to said support tube slidably adjusts to the dimension of a plastic bag.

2. A dishwasher attachment for use in washing a plastic bag, said attachment comprising:

a tube for supporting a plastic bag, the tube being slidably engageable with a rack of a dishwasher; and two clips for securing the bag to said tube, said clips being slidably engageable with said tube, whereby a positioning of said clips relative to said tube may be slidably adjusted according to the dimensions of the bag.

* * * * *